US011326340B2

(12) United States Patent
Dai

(10) Patent No.: US 11,326,340 B2
(45) Date of Patent: May 10, 2022

(54) STEEL TUBE SUPPORTING CONSTRUCTION STRUCTURE FOR BEAM TRANSFER FLOOR IN HIGH-RISE BUILDING AND CONSTRUCTION METHOD THEREFOR

(71) Applicant: Hunan No. 6 Engineering Co. Ltd., Changsha (CN)

(72) Inventor: Xiong Dai, Changsha (CN)

(73) Assignee: HUNAN NO. 6 ENGINEERING CO. LTD., Changsha (CN)

( * ) Notice: Subject to any disclaimer, the term of this patent is extended or adjusted under 35 U.S.C. 154(b) by 0 days.

(21) Appl. No.: 17/159,754

(22) Filed: Jan. 27, 2021

(65) Prior Publication Data

US 2022/0042296 A1 Feb. 10, 2022

(30) Foreign Application Priority Data

Aug. 10, 2020 (CN) ..... 202010797611.9

(51) Int. Cl.
*E04B 1/24* (2006.01)

(52) U.S. Cl.
CPC .... *E04B 1/2403* (2013.01); *E04B 2001/2415* (2013.01)

(58) Field of Classification Search
CPC .. E04B 1/2403; E04B 2001/2415; E04B 5/19; E04B 1/16; E04B 1/046; E04B 1/161; E04B 1/043; E04B 1/19; E04B 1/1903; E04B 1/1909; E04H 12/342; E04G 11/20; E04G 11/22; E04G 11/24; E04G 11/48; E04G 13/028; E04G 13/021; E04G 13/023; E04G 13/025; E04G 13/026; B28B 7/168; B28B 7/22; B28B 7/241
USPC ..... 52/263, 414, 576, 578, 583.1, 587.1, 52/236.5, 251, 253, 295, 319, 648.1, 52/653.1
See application file for complete search history.

(56) References Cited

U.S. PATENT DOCUMENTS

RE13,488 E * 11/1912 Martin ..... 52/251
1,045,520 A * 11/1912 Conzelman ..... E04B 1/185 52/283
2,979,169 A * 4/1961 Morden ..... E04B 1/19 52/654.1

(Continued)

*Primary Examiner* — Brian E Glessner
*Assistant Examiner* — Adam G Barlow
(74) *Attorney, Agent, or Firm* — Hoffmann & Baron, LLP

(57) ABSTRACT

A steel tube supporting construction structure for beam transfer floor in high-rise building and a construction method therefor are provided. The construction structure includes an upper beam formwork, a lower beam formwork, and a stand. The lower beam formwork is provided with a first column formwork on a top wall thereof, the upper beam formwork is detachably provided with a second column formwork on the bottom wall thereof. The second column formwork is detachably provided with a bottom formwork on a lower end of the second column formwork. The second column formwork is provided with a connecting member respectively on an upper end and a lower end thereof for connecting with the upper beam formwork, the lower beam formwork and the bottom formwork. The first column formwork and the second column formwork are each detachably provided with an upright barrel formwork in the vertical direction.

18 Claims, 4 Drawing Sheets

(56) References Cited

U.S. PATENT DOCUMENTS

| | | | | | |
|---|---|---|---|---|---|
| 3,136,024 | A * | 6/1964 | La Monica | B28B 7/168 | 249/66.1 |
| 3,355,853 | A * | 12/1967 | Wallace | E04G 11/22 | 52/745.13 |
| 4,333,285 | A * | 6/1982 | Koizumi | E04B 1/21 | 52/236.3 |
| 4,717,517 | A * | 1/1988 | Halberstadt | E04B 1/3505 | 249/193 |
| 4,987,719 | A * | 1/1991 | Goodson, Jr. | E04B 1/161 | 249/216 |
| 5,218,802 | A * | 6/1993 | Yoshimura | E04B 1/215 | 52/253 |
| 7,647,742 | B2 * | 1/2010 | Han | E04B 1/24 | 52/741.1 |
| 10,323,402 | B1 * | 6/2019 | Yin | E04B 1/2403 | |
| 2009/0199500 | A1 * | 8/2009 | LeBlang | E04B 5/265 | 52/414 |
| 2013/0047539 | A1 * | 2/2013 | Katsalidis | E04B 1/161 | 52/432 |
| 2018/0163389 | A1 * | 6/2018 | Nitunga | E04H 9/0237 | |
| 2020/0131755 | A1 * | 4/2020 | Nitunga | E04B 1/2604 | |
| 2020/0190799 | A1 * | 6/2020 | Wong | E04C 1/24 | |
| 2021/0332585 | A1 * | 10/2021 | Shumate | B28B 7/22 | |

* cited by examiner

A

STEEL TUBE SUPPORTING CONSTRUCTION STRUCTURE FOR BEAM TRANSFER FLOOR IN HIGH-RISE BUILDING AND CONSTRUCTION METHOD THEREFOR

CROSS-REFERENCE TO RELATED APPLICATIONS

This application claims priority to Chinese Patent Application No. 202010797611.9, entitled "STEEL TUBE SUPPORTING CONSTRUCTION STRUCTURE FOR BEAM TRANSFER FLOOR IN HIGH-RISE BUILDING AND CONSTRUCTION METHOD THEREFOR," filed on Aug. 10, 2020, the disclosure of which is incorporated herein by reference in its entirety for all purposes.

TECHNICAL FIELD

The present disclosure relates to the technical field of construction of buildings, and in particular to a steel tube supporting construction structure for beam transfer floor in high-rise building and a construction method therefor.

BACKGROUND

Since different building layers of high-rise building adopts spatial distributions with different functional requirements, requiring different structure forms; and a transfer structure, such as a transfer floor, is provided at a joint between two structures. There is a large cross section, a large self-weight, and a large difficulty in construction in the beam transfer floor. Currently, supporting solutions for formwork of beam transfer floor, such as erecting multi-floor formwork by employing a load transmission and erecting formwork by employing a coincidence pouring, are configured for construction of a beam transfer floor during engineering.

When the transfer floor is poured by employing the coincidence pouring, it is required that the transfer floor is poured for 2-3 times, and a lower beam is poured first, and a middle beam and a upper beam are then poured after the strength of the concrete of the lower beam is up to 100%. There are defects in the construction that have a long period and have a great impact on engineering quality of the beam.

SUMMARY

In order to shorten construction period, a steel tube supporting construction structure for beam transfer floor in a high-rise building and a construction method therefor are provided according to the present disclosure.

In a first aspect, it is provided a steel tube supporting construction structure for beam transfer floor in a high-rise building according to the present disclosure, and the following technical solutions are adopted: a steel tube supporting construction structure for beam transfer floor in high-rise building, which includes an upper beam formwork, a lower beam formwork and a stand; the upper beam formwork and the lower beam formwork are separately and fixedly arranged on the stand from top to bottom; the lower beam formwork are vertically provided on a top wall thereof with a first column formwork, the first column formwork has a first opening on the top thereof; the upper beam formwork are provided in a bottom wall thereof with a through hole adapted to the first opening of the first column formwork; the upper beam formwork is detachably provided on the bottom wall thereof with a second column formwork, the second column formwork has a second opening at its an upper end and a third opening at its a lower end; the second column formwork is slidably arranged on the stand in a vertical direction; the second column formwork is detachably provided at the low end thereof with a bottom formwork, for opening and closing the third opening at the lower end of the second column formwork; the second column formwork is provided on an upper end and a lower end thereof with connecting members for connecting with the upper beam formwork, the lower beam formwork and the bottom formwork; an upright barrel formwork is detachedly provided in both the first column formwork and the second column formwork in a vertical direction.

When the transfer floor is constructed by builders, by adopting the above technical solutions, the upper beam formwork, the lower beam formwork and the first column formwork are firstly mounted; next, the second column formwork is jointly mounted at the through hole on the bottom wall of the upper beam formwork, the bottom of the second column formwork is sealed by the bottom formwork; and the upright barrel formwork is mounted in the first column formwork and the second column formwork respectively, with a bottom of the upright barrel formwork being flush with a top wall of the bottom formwork and a bottom wall of the lower beam formwork; next, concrete is poured into the upper beam formwork and the lower beam formwork in one time and vibrated; the bottom formwork and two upright barrel formworks are removed after the concrete sets; the second column formwork is removed from the upper beam formwork, the second column formwork is slid to a gap between a formed first column and a formed second column, the second column formwork is connected with the first column formwork; and then concrete is poured through the first opening at the top of the upper beam formwork to fill the upright barrels in the upper beam formwork and the lower beam formwork and the gap between the first column and the second column and the poured concrete is vibrated, i.e., completing the pouring process of the transfer floor. Pouring time in one time and time of waiting for the concrete setting is shortened, effectively reducing the construction period. There is a firm connection between the upper formwork and lower beam formwork, having good structure stability.

In some embodiments, the upright barrel formwork may include a mounting plate, multiple formwork plates, and a driving device. The multiple formwork plates may be vertical and jointly form an entire cylinder. The driving device is configured to drive the multiple formwork plates to rotate synchronously in a same direction. The mounting plate may be detachably mounted on top walls of the first column formwork and the upper beam formwork. A rotating shaft is vertically and fixedly provided on a top wall of each of the multiple formwork plates, adjacent to a vertical side edge of this formwork plate. The mounting plate may be provided with rotating holes in the vertical direction, the rotating shaft may be rotatably inserted into corresponding one of the rotating holes through a bottom end of the rotating holes; the multiple formwork plates may be uniformly distributed around a vertical centerline of the mounting plate; the bottom wall of the multiple formwork plate may be in contact with an inner bottom wall of the bottom formwork; the bottom wall of the multiple formwork plate may be in contact with an inner bottom wall of the lower beam formwork.

When the upright barrel formwork is mounted by builders, by adopting the above technical solutions, the multiple formwork plates of the upright barrel formwork are firstly mounted in the first column formwork and in the second column formwork; next, the mounting plate is fixedly mounted on the top of the first column formwork and the top of the upper beam formwork, with the rotating shaft at the top of the formwork plate being inserted into the corresponding rotating hole of the mounting plate; next, the multiple formwork plates are rotated to form an entire cylinder by the driving device. That is, the concrete can be poured. Positions configured for mounting the upright barrel formwork are formed in the upper beam and the lower beam. It is convenient in operation.

In some embodiments, the driving device may include a rotating rod, a handle and connecting rods. The rotating rod may be rotatably arranged on a bottom wall of the mounting plate. The handle may be arranged above the mounting plate and may be detachably and coaxially connected to the rotating rod. A first end of the connecting rod may be hinged to an outer wall of the rotating rod, and a second end of the connecting rod may be hinged to a movable end of corresponding one of the formwork plates. Hinge shafts at the first end and the second end of the connecting rod are parallel and perpendicular to an axis of the rotating rod.

When the upright barrel formwork is removed by builders, by adopting the above technical solutions, the handle is rotated to drive the rotating rod to rotate, the rotation of the rotating rod is transmitted via the connecting rod when the rotating rod is rotated, and the movable end of the formwork plate is brought close to the rotating rod, enabling the formwork plate to be quickly disengaged from the concrete. It is convenient to remove the upright barrel formwork.

In some embodiments, multiple connecting rod sets are evenly and separately arranged on the rotating rod around the axis of the rotating rod.

By adopting the above technical solutions, multiple connecting rods are provided, and when the rotating rod is rotated, each of multiple formwork plates is uniformly subjected to force, so as to facilitate disengagement from the concrete.

In some embodiments, each of multiple formwork plates may be fixedly provided at the movable end thereof with an extended plate in the vertical direction, and an inner wall of each of the multiple formwork plates may be provided on its edge adjacent to the respective hinge shaft with a clamping groove in the vertical direction, which is adapted to the extended plate.

By adopting the above technical solutions, an extended plate on each of the multiple formwork plates is embedded into the clamping groove on an adjacent formwork plate after multiple formwork plates are rotated to form a cylinder, thereby filling a gap between adjacent formwork plates and improving the sealing performance of the upright barrel formwork.

In some embodiments, the mounting plate may be provided with retainers in a cylinder shape for restricting rotation of the multiple formwork plates. The retainers may be plugs, and the mounting plate may be provided with multiple pin holes on a top wall of the mounting plate in the vertical direction, the multiple pin holes correspond to the multiple formwork plates one by one, and the plugs may be inserted into the multiple pin holes, bottom ends of the plugs may extend through the pin hole and to be below the mounting plate, side walls of the plugs may be in contact with inner side walls of the multiple formwork plates.

By adopting the above technical solutions, builders insert the plugs through the pin holes on the mounting plate to bring the plugs into abutment on an inner side wall of the formwork plates after multiple formwork plates are rotated to form a cylinder, thereby effectively preventing the formwork plates from rotating inwardly, maintaining the cylindrical shape of the upright barrel formwork, and improving the structure stability of the upright barrel formwork.

In some embodiments, the multiple formwork plates may be provided on the bottom walls thereof with an elastic filling layer.

By adopting the above technical solutions, when the formwork plates are mounted, the elastic filling layer at the bottom of the formwork plate abuts on an inner bottom wall of the bottom formwork or an inner bottom wall of the lower beam formwork, and gap at the bottom of the formwork plates is filled by the elastic filling layer, thereby improving the sealing property of the upright barrel formwork.

In some embodiments, each of the multiple formwork plates may be provided on outer side wall thereof with anti-sticking layer.

By adopting the above technical solutions, the outer side walls of the formwork plates are sprayed with the anti-sticking layer, and the formwork plates can be more easily removed from the concrete when the formwork plates are dismounted, thereby improving the dismounting efficiency of the formwork plates.

In some embodiments, the connecting members may be a sliding pin. The bottom wall of the upper beam formwork, a top wall of the first column formwork and a top wall of the bottom formwork may be all fixedly connected with plugging plates. The second column formwork may be provided at the upper end and the lower end thereof with plugging grooves, which are adapted to the respective plugging plates. A fixing barrel is provided on the outer wall of the second column formwork respectively at two sides of the plugging groove. The sliding pin may be slidably arranged in the fixing barrel along a horizontal direction. A mounting barrel is provided on the outer wall of the plugging plate, which is adapted to the sliding pin on the outer wall of the plugging plate. The fixing barrels can be coaxially aligned with the mounting barrel when the plugging plates may be inserted into the plugging grooves.

When the second column formwork is mounted by builders, by adopting the above technical solutions, the plugging grooves at the upper end and the lower end of the second column formwork are aligned with and plugged into the plugging plate on the bottom wall of the upper beam formwork, the plugging plate on the top of the first column formwork, or the plugging plate on the top wall of the bottom formwork. Then, the sliding pin is slid through the mounting barrel on the plugging plate and the fixing barrels on both sides of the corresponding plugging groove, thereby completing the installation and fixing of the second column formwork. It is fast and convenient to operate.

In a second aspect, it is provided a steel tube supporting construction method for a beam transfer floor in high-rise building according to the present embodiment, and the following technical solutions are adopted.

It is provided a steel tube supporting construction method for a beam transfer floor in high-rise building, which includes the following steps: step of erecting the stand, employing steel tubes in a Full Staging Method to erect the stand around the building; step of erecting the beam formworks, successively erecting the lower beam formwork, a first column formwork, a bottom formwork, a second column formwork and an upper beam formwork from bottom to top on the stand to have a fourth opening formed at a top of the upper beam formwork and the second opening at the top of the first column formwork, and respectively mounting an upright barrel formwork in the first column formwork and the second column formwork; step of constructing an upper beam and a lower beam, pouring concrete into the upper beam formwork and into the lower beam formwork to a pouring height being not higher than a height of the upright barrel formwork, and vibrating the poured concrete, and curing the poured upper beam and the poured lower beam until being formed; step of mounting a vertical beam formwork, removing the bottom formwork, removing the upright barrel formwork in the upper beam and the upright barrel formwork in the lower beam, disconnecting the second column formwork with the upper beam formwork, sliding the second column formwork downward to abut with the first column formwork, and then fixing the second column formwork to the first column formwork; step of constructing a vertical beam, pouring concrete from a position previously configured for mounting the upright barrel formwork and located at the top of the upper beam, up to be flush with the top wall of the upper beam; inserting a vibrating rod from the position at the top of the upper beam for vibrating, and curing the poured concrete in the vertical beam until being formed.

By adopting the technical solutions, the upper beam and the lower beam can be poured in one time, and then the vertical beam at the joint between the upper beam and the lower beam is poured. Compared with the prior art, time of pouring concrete in one time and time of waiting for the poured concrete setting is saved to effectively reduce the construction period. There is more firm connection between the upper formwork and lower beam formwork, having good stability.

In summary, the present disclosure may include at least one of the following beneficial technical effects:

1. The upper beam and the lower beam are poured in one time, and then the vertical beam at the joint between the upper beam and the lower beam is poured. Compared with the prior art, time of pouring concrete and time of waiting for the concrete setting is saved to effectively reduce the construction period. There is more firm connection between the upper formwork and lower beam formwork, having good stability.

2. When the upright barrel formwork is removed by builders, the handle is rotated to drive the rotating rod to rotate, the rotation of the rotating rod is transmitted via the connecting rods when the rotating rod is rotated, and the movable end of the formwork plates is brought close to the rotating rod, enabling the formwork plate to be quickly disengaged from the concrete. It is convenient to remove the upright barrel formwork.

3. Builders insert the plugs through the pin holes in the mounting plate to bring the plugs into abutment on the inner side wall of the formwork plates after the multiple formwork plates are rotated to form a cylinder, thereby effectively preventing the formwork plates from rotating inwardly, maintaining the cylindrical shape of the upright barrel formwork, and improving the structure stability of the upright barrel formwork.

Throughout the drawings, numerical symbols represent the following: 1 upper beam formwork; 11 lower beam formwork; 12 stand; 2 first column formwork; 3 second column formwork; 31 through hole; 4 bottom formwork; 5 upright barrel formwork; 51 mounting plate; 511 rotating hole; 52 formwork plate; 521 rotating shaft; 522 extended plate; 523 clamping groove; 53 driving device; 531 rotating rod; 532 handle; 533 connecting rod; 6 plug; 61 pin hole; 7 sliding pin; 71 plugging plate; 72 plugging groove; 73 fixing barrel; 74 mounting barrel; 75 elastic filling layer.

DETAILED DESCRIPTION OF PREFERRED EMBODIMENTS

The present disclosure is further illustrated in detail below with reference to FIGS. 1-4.

Figure 1:
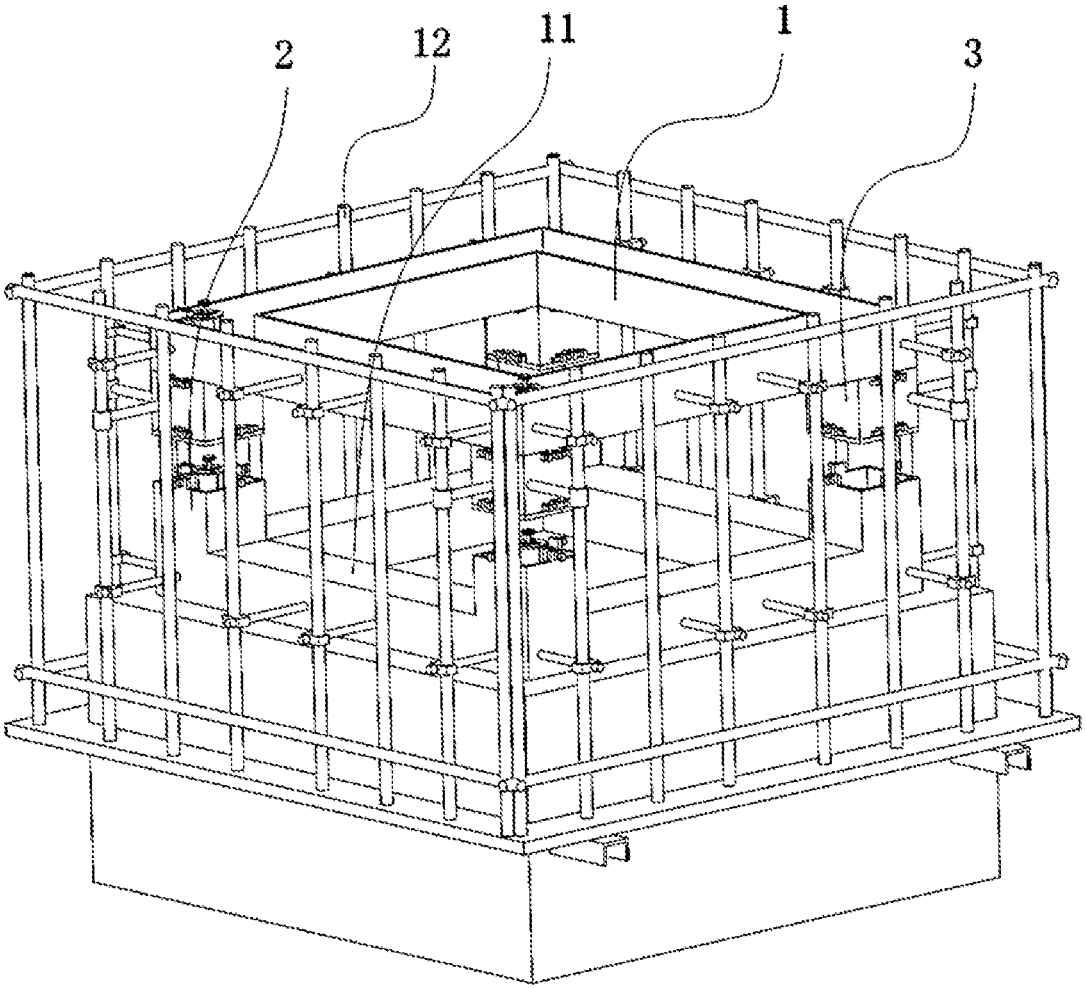
FIG. 1 is a schematic view of an overall structure of an embodiment of the present disclosure.

It is provided a steel tube supporting construction structure for a beam transfer floor in high-rise building by embodiments of the present disclosure. Referring to FIG. 1, the s steel tube supporting construction structure for a beam transfer floor in high-rise building includes an upper beam formwork 1, a lower beam formwork 11 and a stand 12. The stand 12 is mounted and erected by employing common steel tubes in a Full Staging Method and around the periphery of a region of the transfer floor to be constructed. The lower beam formwork 11 is mounted on the floor, and is fixedly connected to the stand 12 via a connecting steel tube. The upper beam formwork 1 is just located above the lower beam formwork 11, and is fixedly connected to the stand 12 via a connecting steel tube.

Figure 2:
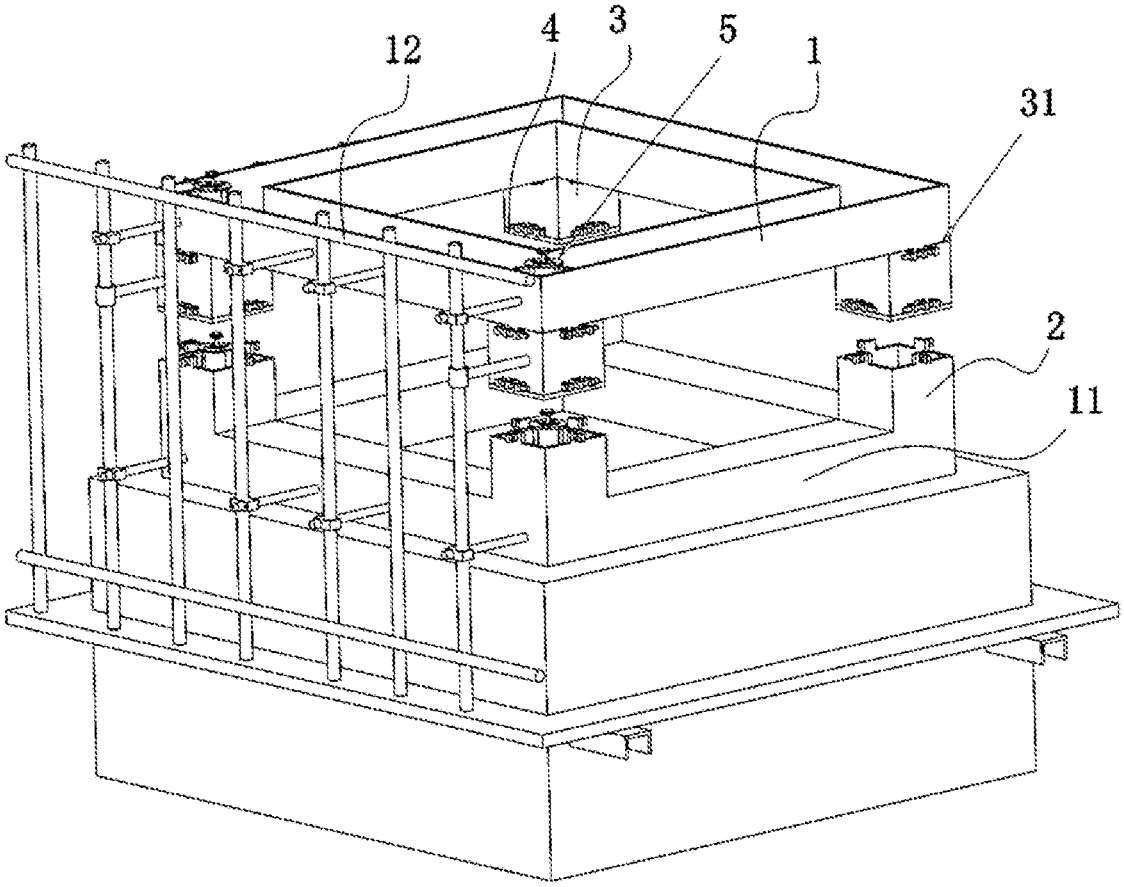
FIG. 2 is a schematic view of an overall structure of an embodiment of the present disclosure, with part of a stand to be hidden.

Referring to FIGS. 1 and 2, the lower beam formwork 11 has a hollow inner, with a bottom wall being flush with the floor. The lower beam formwork 11 is provided with a through hole on a top wall thereof at a position configured for a vertical beam, the through hole is communicated with the inner of the lower beam formwork 11. The first column formwork 2 is fixedly connected to an upper part of the lower beam formwork 11. The first column formwork 2 is erected around the through hole, with a first opening on the top thereof. The first column formwork 2 is fixedly connected to the stand 12 via a connecting steel tube.

Referring to FIGS. 1 and 2, the upper beam formwork 1 has a hollow inner and an opened top. The upper beam formwork 1 is provided with a through hole 31 on a bottom wall thereof at a position configured for the vertical beam, the through hole 31 is communicated with the inner of the upper beam formwork 1. A second column formwork 3 is provided between the upper beam formwork 1 and the first column formwork 2. The second column formwork 3 is opened at an upper end and lower end thereof. A height of the second column formwork 3 is less than a distance between the upper beam formwork 1 and the first column formwork 2, and is greater than one-half of the distance between them. A supporting steel tube is welded on an outer wall of the second column formwork 3. An end of the supporting steel tube is fixedly connected with a mounting sleeve. The mounting sleeve is slidably sleeved over the stand 12 in a vertical direction. The second column formwork 3 can slide up and down in the vertical direction between the upper beam formwork 1 and the first column formwork 2.

Figure 3:
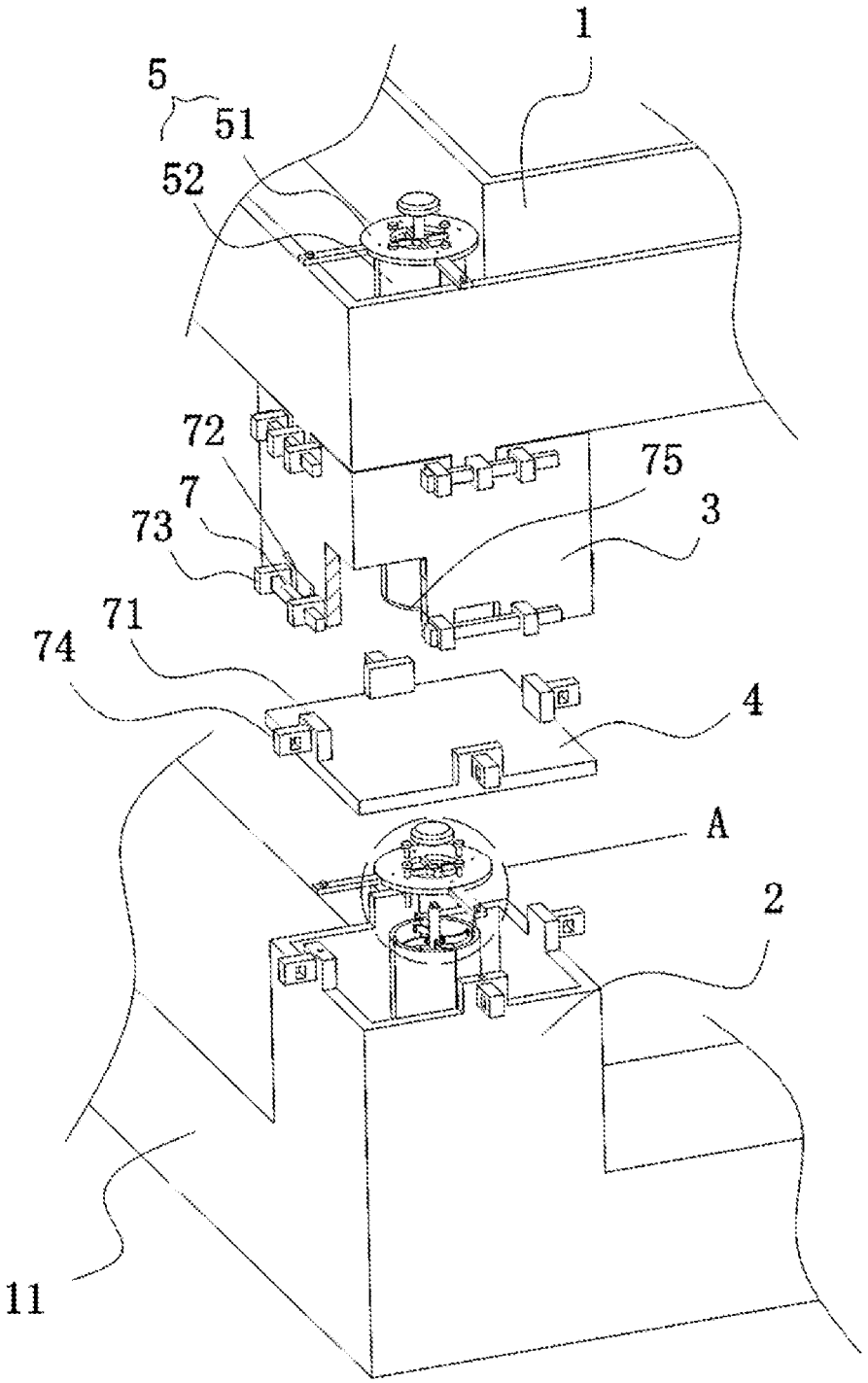
FIG. 3 is a partial cross-sectional view of structure of a second column formwork according to an embodiment of the present disclosure.

Referring to FIG. 3, a vertical plugging plate 71 is integrally and fixedly provided respectively on the bottom wall of the upper beam formwork 1 and the top wall of the first column beam formwork 2. The second column formwork 3 is provided with a plugging groove 72 respectively at an upper end and a lower end hereof at a position corresponding to the plugging plate 71, which is adapted to a shape of the plugging plate 71. Four groups of the plugging groove 72 and the plugging plate 71 are provided on the upper beam formwork 1, the first column formwork 2 and the second column formwork 3 and are uniformly arranged around four faces of the vertical beam.

Referring to FIG. 3, the bottom of the second column formwork 3 is provided with a bottom formwork 4 for closing the third opening at the bottom of the second column formwork 3. The bottom formwork 4 has the same size as that of the cross-section of the second column formwork 3. The top wall of the bottom formwork 4 is welded and fixed with the vertical plugging plate 71 at the periphery of the bottom formwork 4, adapted to the plugging groove 72 of the second column formwork 3. The second column formwork 3 is connected to the upper beam formwork 1, the first column formwork 2 and the bottom formwork 4 via a connecting member respectively. In this embodiment, the connecting member is a sliding pin 7. The plugging plate 71 is welded with a mounting barrel 74 on the outer side wall thereof. The mounting barrel 74 is provided with a mounting hole with a horizontal center line. Fixing barrels 73 are respectively fixedly welded on two sides of each of the plugging groove 72 of the second column formwork 3. Each of the fixing barrels 73 is provided with a sliding hole with a horizontal center line. The sliding pin 7 is slidably mounted within the mounting hole. When the plugging plate 71 is plugged into and fitted with the plugging groove 72, the mounting barrel 74 is coaxial with the fixing barrels 73 on both sides of the plugging groove 72, and the sliding pin 7 slides through the mounting barrels 74 and two fixing barrels 73 at the same time, that is, completing connection between the plugging plate 71 and the second column formwork 3.

Figure 4:
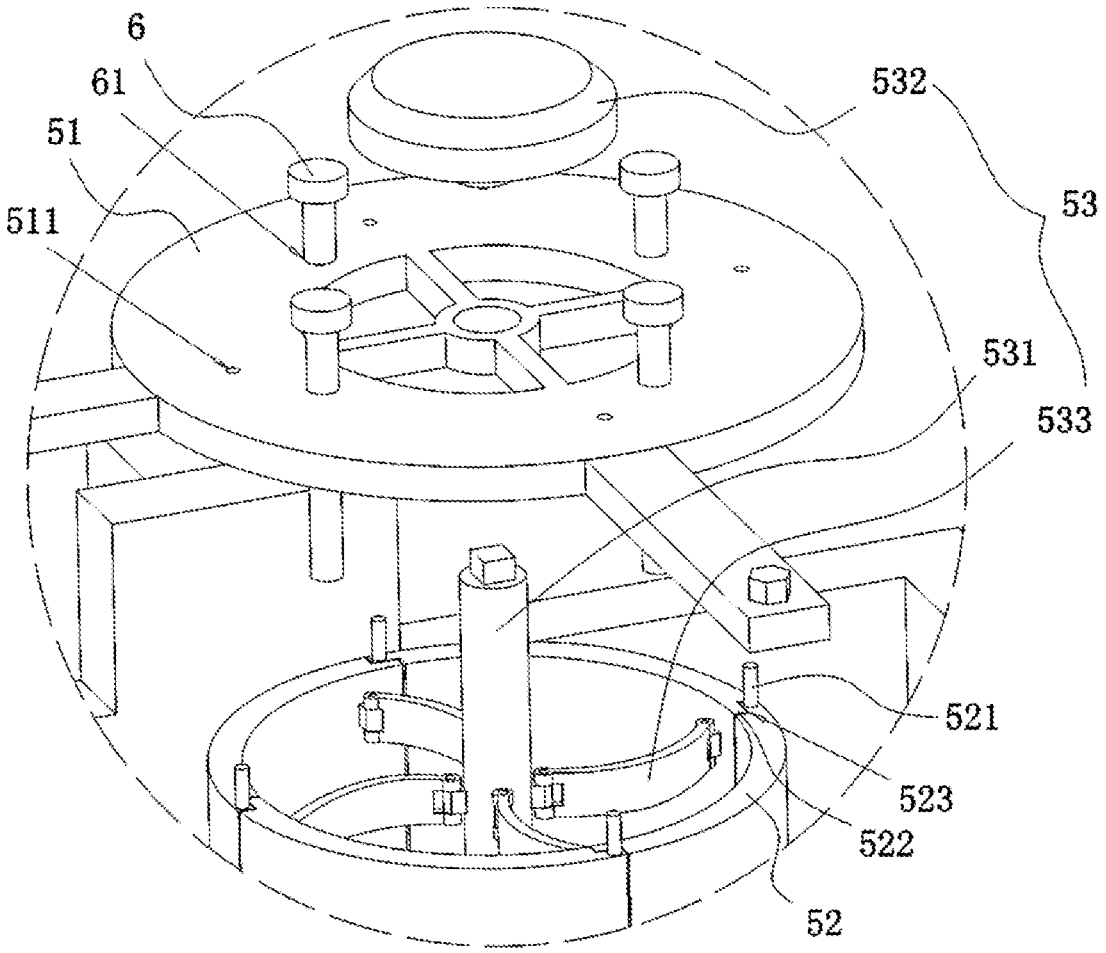
FIG. 4 is a partial enlarged view of A part of FIG. 3.

Referring to FIGS. 3 and 4, an upright barrel formwork 5 is detachably mounted in the first column formwork 2 and the second column formwork 3. The upright barrel formwork 5 may include a mounting plate 51 and multiple formwork plates 52. The mounting plate 51 can be fixedly connected to the top of the first column formwork 2 and the top of the upper beam formwork 1 via a bolt. The plurality of formwork plates 52 are vertically inserted into the first column formwork 2 or the second column formwork 3. The vertical edges of the plurality of formwork plates 52 are successively end to end and the concave surfaces thereof are directly opposite to each other, so as to enclose an entire cylindrical upright barrel. In this embodiment, there are four formwork plates 52. An elastic filling layer 75 is fixedly bonded at a bottom of the formwork plate 52. The elastic filling layer 75 may be of rubber and is configured for filling a gap between the bottom of the formwork plate 52 and the floor or a gap between the bottom of the formwork plate and the top wall of the bottom formwork 4. A rotating shaft 521 extends vertically from the top of the formwork plate 52, and the rotating shaft 521 is close to a vertical edge at one side of the formwork plate 52. A rotating hole 511 is provided on the top wall of the mounting plate 51, for inserting and rotating the rotating shaft 521. Four rotating holes 511 are uniformly and circumferentially distributed on the mounting plate 51.

Referring to FIGS. 3 and 4, the mounting plate 51 is provided with a driving device 53 to drive the movable ends of the four formwork plates 52 to rotate inwardly synchronously. In this embodiment, the driving device 53 may include a rotating rod 531, a handle 532 and connecting rods 533. The mounting plate 51 is provided with a mounting hole coaxial with the center line of a circle through centers of the rotating holes 511, and the top end of the rotating rod 531 is rotatably inserted into the mounting hole. The rotating rod 531 is located below the mounting plate 51, the connecting rods 533 are located between the rotating rod 531 and the formwork plates 52, two ends of each of the connecting rods 533 are respectively hinged to an outer side wall of the rotating rod 531 and a movable end of one of the formwork plates 52, and hinged shafts at two ends of each of the connecting rods 533 are both parallel to an axis of the rotating rod 531. Multiple connecting rods 533 are separately provided on the rotating rod 531 in the vertical direction, so that the formwork plates 52 are subjected to uniform pulling force. The top of the rotating rod 531 extends to the top of the mounting plate 51. The top of the rotating rod 531 is welded with an insertion block having a horizontal cross section with a polygonal shape, in particular, an insertion block having a square cross section. A slot adapted to the insertion block is provided at the bottom of the handle 532. When the insertion block is inserted into the slot, the handle 532 is coaxial with the rotating rod 531.

In other embodiments, the driving device 53 may include a rotating rod 531, a driving gear and driven gears. The driving gear is coaxially sleeved over the rotating rod 531. The driven gears are coaxially fixedly sleeved over the rotating shaft 521 of each of the formwork plates 52. The driving gear meshes with the driven gear on each of the formwork plates 52 at the same time, thereby driving each of the formwork plates 52 to rotate synchronously.

Referring to FIGS. 3 and 4, in order to reduce the gap between adjacent formwork plates 52, an extended plate 522 is integrally formed in the vertical direction on the other vertical side wall of the formwork plate 52 far away from the rotating shaft 521 of the same formwork plate 52, and the extended plate 522 is located at a position close to an inner edge of the side wall of each of the formwork plates 52. A clamping groove 523 is provided on the inner wall of the formwork plate 52 at a position close to the vertical side edge where the rotating shaft 521 lies, which is adapted to the extended plate 522. When the formwork plates 52 are formed into a cylinder, the extended plate 522 of each of the formwork plates 52 can be clamped with the clamping groove 523 on an adjacent formwork plate 52.

An outer side wall of each of the formwork plates 52 is provided with an anti-sticking layer to reduce an adhesive force between the formwork plates 52 and the concrete during the dismounting of formworks. In this embodiment, the anti-sticking layer is a Teflon coating, and is coated on the outer side wall of each of the formwork plates 52.

Referring to FIGS. 3 and 4, in order to restrict the rotation of the formwork plates 52 after the formwork plates 52 are rotated to form the cylinder, retainers are provided on the mounting plate 51 for restricting the rotation of the formwork plates 52. In this embodiment, the retainers are plugs 6. Multiple pin holes 61 are provided on the top wall of the mounting plate 51 in the vertical direction. When the formwork plates 52 are rotated to form a cylinder, the plugs 6 are inserted through the pin holes 61 in the mounting plate 51, and contact with the inner side walls of the formwork plates 52, so as to limit the formwork plates 52.

In other embodiments, the formwork plates may be fixed by a bolt. The bolt may pass through the mounting plate 51 and be connected to the top wall of the formwork plates 52 in a threaded manner, so as to fix the formwork plates 52.

Referring to FIGS. 2 and 3, when the upright barrel formwork 5 is mounted, the formwork plates 52 and the rotating rod 531 are firstly inserted into the first column formwork 2 or the second column formwork 3, and then the mounting plate 51 is mounted above the formwork plates 52, so that the rotating shaft 521 of each of the formwork plates 52 is inserted into corresponding rotating hole 511, and the handle 532 is finally mounted. When dismounting the upright barrel formwork 5 in the first column formwork 2, firstly the upright barrel formwork 5 in the upper beam is dismounted, and then the bottom formwork 4 is dismounted, the mounting plate 51 of the upright barrel formwork 5 in the first column formwork 2 is dismounted, and finally the formwork plate 52 in the second column formwork 3 is lifted out from the upper beam formwork 1 by employing a hanger, thereby completing the dismounting of the upright barrel formwork 5.

It is provided a method for the steel tube supporting construction structure for beam transfer floor in high-rise building according to some embodiments of the present disclosure, which include the following steps:

Step of erecting a stand 12, employing common steel tubes in a Full Staging Method to erect the stand 12 at a periphery of a building.

Step of erecting the beam formworks, a lower beam formwork 11 and a first column formwork 2 are successively erected from bottom to top on the stand 12, and an upper beam formwork 1 is erected above the lower beam formwork 11. On the bottom wall of the upper beam formwork 1, the second column formwork 3 is aligned with a through hole 31, and the second column formwork 3 is mounted and fixed by a sliding pin 7. The bottom formwork 4 is aligned with and mounted on the bottom of the second column formwork 3, and then the bottom formwork 4 are fixedly mounted to the second column formwork 3 by employing the sliding pin 7. The top of the upper beam formwork 1 and the top of the first column formwork 2 are each provided with an opening. The formwork plates 52 are successively put into the first column formwork 2 and the second column formwork 3 by employing a hanger before mounting the bottom formwork plate 4. The formwork plates 52 are brought into being against the bottom formwork 4 and surface of floor after the bottom formwork 4 is mounted. The mounting plate 51 is fixedly mounted on the upper beam formwork 1 and the first column formwork 2 by bolts. The rotating shaft 521 on each of the formwork plates 52 is inserted into the corresponding rotating hole 511 on the mounting plate 51. The handle 532 is mounted and the formwork plates 52 are rotated to form a cylinder.

Step of constructing an upper beam and a lower beam, pouring concrete into the upper beam formwork 1 and into the lower beam formwork 11, a pouring height being not higher than that of the upright barrel formwork 5, and vibrating the poured concrete, and waiting for the poured upper beam and the poured lower beam to be formed.

Step of mounting a vertical beam formwork, the sliding pin 7 is slid out, and the bottom formwork 4 is removed. The mounting plate 51 in the upper beam and the mounting plate 51 in the lower beam are removed, and the formwork plates 52 in the upper beam formwork 1 and the formwork plates 52 in the lower beam formwork 11 are lifted up and taken out from the fourth opening on the top wall of the upper beam formwork 1 by a hanger. Next, the sliding pin 7 is slid out, the second column formwork 3 is disconnected from the upper beam formwork 1, the second column formwork 3 is slid down to abut with the first column formwork 2, and the second column formwork 3 is fixedly connected to the first column formwork 2 through the sliding pin 7.

Step of constructing a vertical beam, pouring concrete from a position at the top of the upper beam configured for the upright barrel, to be flush with a top wall of the upper beam, inserting a vibrating rod from the position at the top to vibrate, and waiting for the concrete to be formed.

The above are all preferred embodiments of the present disclosure, and are not intended to limit the scope of protection of the present disclosure. As a result, equivalent changes made according to the structure, shape and principle of the present disclosure should all be encompassed by the protection scope claimed by the present disclosure.

What is claimed is:

1. A steel tube supporting construction structure for a beam transfer floor in a high-rise building, the steel tube supporting construction structure comprising:

an upper beam formwork;

a lower beam formwork; and a stand, the upper beam formwork and the lower beam formwork being separately and fixedly arranged on the stand from top to bottom; the lower beam formwork being vertically provided on a top wall thereof with a first column formwork, the first column formwork having a first opening on the top thereof; the upper beam formwork being provided in a bottom wall thereof with a through hole adapted to the first opening of the first column formwork; the upper beam formwork being detachably provided on the bottom wall thereof with a second column formwork, the second column formwork having a second opening at its an upper end and a third opening at its a lower end; the second column formwork being slidably arranged on the stand in a vertical direction; the second column formwork being detachably provided at the low end thereof with a bottom formwork, for opening and closing the third opening at the lower end of the second column formwork; the second column formwork being provided on an upper end and a lower end thereof with connecting members for connecting with the upper beam formwork, the lower beam formwork and the bottom formwork; an upright barrel formwork being detachedly provided in both the first column formwork and the second column formwork in a vertical direction.

2. The steel tube supporting construction structure according to claim 1, wherein the upright barrel formwork comprises a mounting plate, a plurality of formwork plates which are vertical and jointly form an entire cylinder, and a driving device for driving the plurality of formwork plates to rotate synchronously in a same direction; the mounting plate is detachably mounted on top walls of the first column formwork and the upper beam formwork; a rotating shaft is vertically and fixedly provided on a top wall of each of the plurality of formwork plates, at a position adjacent to one vertical side edge of each of the plurality of formwork plates; the mounting plate is provided with rotating holes in a vertical direction; the rotating shaft is rotatably inserted into a corresponding one of the rotating holes through a bottom end thereof; the plurality of formwork plates are uniformly distributed around a vertical centerline of the mounting plate; bottom walls of the plurality of formwork plates are in contact with an inner bottom wall of the bottom formwork; the bottom walls of the plurality of formwork plates are in contact with an inner bottom wall of the lower beam formwork.

3. The steel tube supporting construction structure according to claim 2, wherein the driving device comprises a rotating rod, a handle and connecting rods; the rotating rod is rotatably arranged on a bottom wall of the mounting plate; the handle is arranged above the mounting plate and is detachably and coaxially connected to the rotating rod; a first end of the each of connecting rods is hinged to an outer wall of the rotating rod, and a second end of each of the connecting rods is hinged to a movable end of corresponding one of the plurality of formwork plates, hinge shafts at the first end and the second end of each of the connecting rods are parallel and are perpendicular to an axis direction of the rotating rod.

4. The steel tube supporting construction structure according to claim 3, wherein a plurality of connecting rod sets are evenly and separately arranged on the rotating rod in the axis direction of the rotating rod.

5. The steel tube supporting construction structure according to claim 2, wherein each of the plurality of formwork plates is fixedly provided at the movable end thereof with an extended plate in a vertical direction; and an inner wall of each of the plurality of formwork plates is provided on its edge adjacent to the respective hinge shaft with a clamping groove in a vertical direction, the clamping groove is adapted to the extended plate.

6. The steel tube supporting construction structure according to claim 2, wherein the mounting plate is provided with retainers in a cylinder shape for restricting rotation of the plurality of formwork plates; the retainers are plugs; the mounting plate is provided with a plurality of pin holes on a top wall of the mounting plate in a vertical direction; the plurality of pin holes correspond to the plurality of formwork plates one by one; the plugs are inserted into the plurality of pin holes; bottom ends of the plugs extend below the mounting plate; side walls of the plugs are in contact with inner side walls of the plurality of formwork plates.

7. The steel tube supporting construction structure according to claim 2, wherein the plurality of formwork plates are provided on the bottom walls thereof with an elastic filling layer.

8. The steel tube supporting construction structure according to claim 2, wherein each of the plurality of formwork plates is provided on an outer side wall thereof with an anti-sticking layer.

9. The steel tube supporting construction structure according to claim 1, wherein each of the connecting members comprises a sliding pin; the bottom wall of the upper beam formwork, a top wall of the first column formwork and a top wall of the bottom formwork are all fixedly connected with plugging plates, the second column formwork is provided at the upper end and the lower end thereof with plugging grooves adapted to the respective plugging plates; the second column formwork has fixing barrels fixedly connected thereto which are located at two sides of the plugging grooves on an outer wall of the second column formwork; the sliding pin is slidably arranged in the fixing barrel along a horizontal direction; the plugging plate is fixedly connected with a mounting barrel adapted to the sliding pin on an outer wall of the plugging plate; the fixing barrels are coaxially aligned with the mounting barrel when the plugging plates are inserted into and fitted with the respective plugging grooves.

10. A steel tube supporting construction method for a beam transfer floor in high-rise building, using a steel tube supporting construction structure for a beam transfer floor in high-rise building, wherein, the steel tube supporting construction structure comprises an upper beam formwork, a lower beam formwork and a stand, the upper beam formwork and the lower beam formwork being separately and fixedly arranged on the stand from top to bottom, the lower beam formwork being vertically provided on a top wall thereof with a first column formwork, the first column formwork having a first opening on the top thereof, the upper beam formwork being provided in a bottom wall thereof with a through hole adapted to the first opening of the first column formwork, the upper beam formwork being detachably provided on the bottom wall thereof with a second column formwork, the second column formwork having a second opening at its an upper end and a third opening at its a lower end, the second column formwork being slidably arranged on the stand in a vertical direction, the second column formwork being detachably provided at the low end thereof with a bottom formwork, for opening and closing the third opening at the lower end of the second column formwork, the second column formwork being provided on an upper end and a lower end thereof with connecting members for connecting with the upper beam formwork, the lower beam formwork and the bottom formwork, an upright barrel formwork being detachedly provided in both the first column formwork and the second column formwork in a vertical direction, the method comprising:

erecting the stand, employing steel tubes Full Staging Method to erect the stand around the building;

erecting the beam formworks, successively erecting the lower beam formwork, the first column formwork, the bottom formwork, the second column formwork and the upper beam formwork from bottom to top on the stand, to have a fourth opening formed at a top of the upper beam formwork and the second opening formed at the top of the first column formwork, and mounting the upright barrel formwork both in the first column formwork and the second column formwork;

constructing an upper beam and a lower beam, pouring concrete into the upper beam formwork and into the lower beam formwork to a pouring height not higher than a height of the upright barrel formwork, and vibrating the poured concrete, and curing the upper beam and the lower beam until being formed;

mounting a vertical beam formwork, removing the bottom formwork, removing the upright barrel formwork in the upper beam and the upright barrel formwork in the lower beam, disconnecting the second column formwork with the upper beam formwork, sliding the second column formwork downward to interface with the first column formwork, and then fixing the second column formwork to the first column formwork;

constructing a vertical beam, pouring concrete from a position for mounting the upright barrel formwork before removal and located at a top of the upper beam, up to be flush with a top wall of the upper beam, inserting a vibrating rod through the position of the upper beam formwork before removal for vibrating, and curing the poured vertical beam until being formed.

11. The method according to claim 10, wherein the upright barrel formwork comprises a mounting plate, a plurality of formwork plates which are vertical and jointly form an entire cylinder, and a driving device for driving the plurality of formwork plates to rotate synchronously in a same direction; the mounting plate is detachably mounted on top walls of the first column formwork and the upper beam formwork; a rotating shaft is vertically and fixedly provided on a top wall of each of the plurality of formwork plates, at a position adjacent to one vertical side edge of each of the plurality of formwork plates; the mounting plate is provided with rotating holes in a vertical direction; the rotating shaft is rotatably inserted into corresponding one of the rotating holes through a bottom end thereof; the plurality of formwork plates are uniformly distributed around a vertical centerline of the mounting plate; bottom walls of the plurality of formwork plates are in contact with an inner bottom wall of the bottom formwork; the bottom walls of the plurality of formwork plates are in contact with an inner bottom wall of the lower beam formwork.

12. The method according to claim 11, wherein the driving device comprises a rotating rod, a handle and connecting rods; the rotating rod is rotatably arranged on a bottom wall of the mounting plate; the handle is arranged above the mounting plate and is detachably and coaxially connected to the rotating rod; a first end of the each of connecting rods is hinged to an outer wall of the rotating rod, and a second end of each of the connecting rods is hinged to a movable end of corresponding one of the plurality of formwork plates, hinge shafts at the first end and the second end of each of the connecting rods are parallel and are perpendicular to an axis direction of the rotating rod.

13. The method according to claim 12, wherein a plurality of connecting rod sets evenly and separately arranged on the rotating rod in the axis direction of the rotating rod.

14. The method according to claim 11, wherein each of the plurality of formwork plates is fixedly provided at the movable end thereof with an extended plate in a vertical direction; and an inner wall of each of the plurality of formwork plates is provided on its edge adjacent to the respective hinge shaft with a clamping groove in a vertical direction, the clamping groove is adapted to the extended plate.

15. The method according to claim 11, wherein the mounting plate is provided with retainers in a cylinder shape for restricting rotation of the plurality of formwork plates; the retainers are plugs; the mounting plate is provided with a plurality of pin holes on a top wall of the mounting plate in a vertical direction; the plurality of pin holes correspond to the plurality of formwork plates one by one; the plugs are inserted into the plurality of pin holes; bottom ends of the plugs extend below the mounting plate; side walls of the plugs are in contact with inner side walls of the plurality of formwork plates.

16. The method according to claim 11, wherein the plurality of formwork plates are provided on the bottom walls thereof with an elastic filling layer.

17. The method according to claim 11, wherein each of the plurality of formwork plates is provided on an outer side wall thereof with an anti-sticking layer.

18. The method according to claim 10, wherein each of the connecting members is a sliding pin; the bottom wall of the upper beam formwork, a top wall of the first column formwork and a top wall of the bottom formwork are all fixedly connected with plugging plates, the second column formwork is provided at the upper end and the lower end thereof with plugging grooves adapted to the respective plugging plates; the second column formwork has fixing barrels fixedly connected thereto which are located at two sides of the plugging grooves on an outer wall of the second column formwork; the sliding pin is slidably arranged in the fixing barrel along a horizontal direction; the plugging plate is fixedly connected with a mounting barrel adapted to the sliding pin on an outer wall of the plugging plate; the fixing barrels are coaxially aligned with the mounting barrel when the plugging plates are inserted into and fitted with the respective plugging grooves.

* * * * *